US007895754B2

(12) United States Patent
Blackburn

(10) Patent No.: US 7,895,754 B2
(45) Date of Patent: Mar. 1, 2011

(54) SAFETY RAZORS

(75) Inventor: Richard Blackburn, Centre Bretagne (FR)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 12/478,297

(22) Filed: Jun. 4, 2009
(Under 37 CFR 1.47)

(65) Prior Publication Data

US 2009/0255136 A1 Oct. 15, 2009

Related U.S. Application Data

(63) Continuation of application No. 11/433,540, filed on May 12, 2006, now Pat. No. 7,578,062, which is a continuation of application No. PCT/GB2004/004766, filed on Nov. 11, 2004.

(30) Foreign Application Priority Data

Nov. 14, 2003 (GB) ..... 0326646.7

(51) Int. Cl.
*B26B 21/52* (2006.01)

(52) U.S. Cl. ..... 30/58; 30/74; 30/527

(58) Field of Classification Search ..... 30/34.04, 30/41.7, 41.8, 47, 43.1, 50, 58, 74, 84, 527, 30/34.05, 532
See application file for complete search history.

(56) References Cited

U.S. PATENT DOCUMENTS

| | | | |
|---|---|---|---|
| 2,643,579 | A | 6/1953 | Jacoby |
| 2,885,778 | A | 5/1959 | Randol |
| 2,967,354 | A | 1/1961 | Ahlborn |
| 3,740,841 | A | 6/1973 | Risher |
| 3,872,587 | A | 3/1975 | Wellinger |
| 4,245,388 | A | 1/1981 | Dawidowicz et al. |
| 4,284,968 | A | 8/1981 | Denoyelle et al. |
| 4,471,331 | A | 9/1984 | Wyatt |
| 4,496,921 | A | 1/1985 | Carrera |
| 4,791,724 | A | 12/1988 | Dumas |
| 5,526,568 | A | 6/1996 | Copelan |
| 5,848,475 | A | 12/1998 | Hill et al. |
| 5,868,055 | A | 2/1999 | Suter |
| 5,953,825 | A | 9/1999 | Christman et al. |

(Continued)

FOREIGN PATENT DOCUMENTS

| | | |
|---|---|---|
| FR | 2 660 589 | 10/1991 |

(Continued)

OTHER PUBLICATIONS

GB Search Report in corresponding appln. GB 0326646.7 dated Feb. 5, 2004.

(Continued)

*Primary Examiner*—Timothy V Eley
(74) *Attorney, Agent, or Firm*—Ronald T. Sia; Kevin C. Johnson; Steven W. Miller

(57) ABSTRACT

A safety razor blade unit mounted for pivotal movement relative to a razor handle is biased to a normal rest position by a magnetic return force generated by a pair of magnets that are so disposed that the return force increases as the pivotal displacement of the blade unit from the rest position increases.

14 Claims, 2 Drawing Sheets

U.S. PATENT DOCUMENTS

| | | | |
|---|---|---|---|
| 6,035,535 | A | 3/2000 | Dischler |
| 6,397,473 | B1 | 6/2002 | Clark |
| 6,421,918 | B1 | 7/2002 | Dato et al. |
| 7,200,942 | B2 | 4/2007 | Richard |
| 2001/0006069 | A1 | 7/2001 | Treskov et al. |
| 2003/0209829 | A1 | 11/2003 | Brown et al. |
| 2004/0098862 | A1 | 5/2004 | Orloff |

FOREIGN PATENT DOCUMENTS

| | | | |
|---|---|---|---|
| FR | 2 663 255 | | 12/1991 |
| GB | 512440 | | 9/1939 |
| RU | 2093349 | C1 | 10/1997 |
| WO | WO 93/10947 | | 6/1993 |
| WO | WO 97/37819 | | 10/1997 |
| WO | WO 01/39937 | | 6/2001 |

OTHER PUBLICATIONS

Translation of RU 2093349C1, Mar. 1, 1993.

SAFETY RAZORS

CROSS-REFERENCE TO RELATED APPLICATIONS

This application is a continuation application of U.S. patent application Ser. No. 11/433,540 filed on May 12, 2006 now U.S. Pat. No. 7,578,062, which is a continuation application of and claims priority to PCT International Application No. PCT/GB2004/004766, filed on Nov. 11, 2004, which claims priority to GB 0326646.7, filed on Nov. 14, 2003. Both applications are hereby incorporated by reference.

TECHNICAL FIELD

This invention relates to safety razors and it is particularly concerned with safety razors in which a safety razor blade unit including at least one blade with a sharp cutting edge is mounted on a razor handle to be movable pivotally relative to the handle under forces exerted on the blade unit in the course of shaving. A blade unit may have a plurality blades, for example two, three, four or more blades, with straight parallel cutting edges disposed for contact with the skin between guard and cap surfaces also provided on the blade unit. The guard may include a strip of elastomeric material with a surface configuration, for example upstanding projections such as in the shape of fins, to produce a desired interaction with the skin as the blade unit is moved across the skin in the performance of a shaving stroke. The cap surface may include a strip of material containing a shaving enhancement product, such as a lubricant, which can gradually leach out of the strip material for application to the skin during shaving. The safety razor blade unit may be mounted detachably on the razor handle to allow the blade unit to be replaced by a fresh blade unit when the blade sharpness has diminished to an unsatisfactory level. Alternatively, the blade unit can be connected permanently to the handle with the intention that the entire razor should be discarded when the blade or blades have become dulled. Detachable and replaceable blade units are commonly referred to as shaving cartridges.

BACKGROUND

As mentioned above the present invention relates to safety razors with blades units arranged to be capable of pivoting movement relative to the handles, on which the blade units are carried, in the course of shaving. The pivoting motion allows the blade unit to follow more easily the skin contours so that the exact angle at which the handle is held relative to the skin is less critical to achieving a good shaving performance and efficiency. Razors with pivotal blade units have been successfully marketed for many years. The pivot axis, which usually extends parallel to the cutting edges of the blades, can be defined by a pivot structure by means of which the handle is connected to the blade unit. Alternatively the blade unit may include an attachment member to which a frame or housing incorporating the blade or blades and other skin contacting parts is pivotally connected. A blade unit of this form described in WO 97/37819, the content of which is incorporated herein by reference, has an attachment member in the general form of a yoke with a hub for engagement with the upper end of the handle and a pair of oppositely directed arms provided with pivot journals at their ends for engagement in sockets provided at the ends of the frame. Retention clips are applied around the respective ends of the frame to maintain the pivot journals within the sockets.

Various positions of the pivot axis relative to the blade edges have been proposed and used, including positions above and below a plane tangential to the guard and cap surfaces, and positions in front of, behind and in the region of the blade edges. There is generally a rest position to which the pivotable blade unit is biased by a spring arrangement and many different forms of mechanical spring arrangement have been suggested in the prior art.

The blade unit can be mounted to pivot in either direction from the rest position, but it has been found advantageous to have the pivot axis located in front of the blades, more exactly in the vicinity of the guard, below the plane tangential to the guard and cap surfaces, and for the blade unit to be arranged to pivot in one direction only from the rest position, as described in WO 93/10947. In the Mach 3 razor currently marketed by the Applicant, the blade unit is pivotally mounted in this manner. It includes an attachment member as described above for connection to the handle, and there is a spring-loaded plunger that projects from the handle and through the hub of the attachment member to bear on the underside of the frame to bias the blade unit to the rest position. A small coil spring urges the plunger outwardly. The frictional effects which are unavoidable with such a mechanical spring arrangement are difficult to control with the result that a smooth and consistent pivoting performance is difficult to guarantee.

The present invention addresses this drawback by employing a magnetically generated return force. Prior art proposals in which magnets are provided in safety razors include those described in: U.S. Pat. No. 2,885,778, wherein magnets are employed to hold a removable blade when the razor head is opened, e.g. for rinsing away shaving soap and debris; U.S. Pat. No. 3,740,841, wherein a blade is mounted on a pivotal carrier to be retractable against a bias, from a normal shaving position relative to a fixed guard, when excessive forces are exerted on the blade, and either a spring or a pair of magnets applies the bias; U.S. Pat. No. 5,526,568, wherein a blade unit is rotatable about an axis perpendicular to the length of the blade unit, and a mechanism incorporated in the handle for adjusting the blade unit position can include magnets for maintaining the blade unit in the adjusted position; U.S. Pat. No. 6,035,535 in which magnets are employed to attach a flexible shaving cartridge to a razor handle; FR 2660589, wherein a pivot structure connecting a razor head to a handle incorporates magnets to hold the razor head in the pivotal position to which it is adjusted; and RU 2093349, wherein a pivotal blade unit is urged to an initial working position by a permanent magnet disposed on the handle to attract the underside of the blade unit the arrangement being such that the attraction will diminish as the blade unit pivots away from the initial position.

SUMMARY

Provided in accordance with the present invention is a safety razor comprising a handle and a blade unit with a guard, a cap and at least one blade, the blade unit being mounted to the handle for movement relative thereto about a pivot axis for following the skin contours during shaving, the blade unit having a normal rest position towards which the blade unit is biased by a return force when pivoted away from the rest position, wherein the return force comprises a magnetic force that increases in magnitude as the blade unit pivots away from the rest position.

By use of a magnetically generated restoring force a very smooth and consistently reproduceable pivotal movement can be ensured. The magnetic force can be conveniently generated by magnetic elements that are moved relative to each other in response to pivotal movement of the blade unit relative to the handle, and interact repulsively to urge the blade unit to the rest position.

In a presently preferred embodiment the magnetic force is generated by a pair of opposed magnetic elements, but more than two magnetic elements could be used, e.g. in two sets of opposed pairs.

Conveniently the blade unit is pivotally carried by a pair of opposed arms extending from a hub, and a second one of the magnetic elements is positioned on the hub.

The invention also resides in a safety razor blade unit for a safety razor as described above, the blade unit comprising a frame with a cap and guard, one or more blades carried by the frame between the cap and guard, a pivot structure provided on the frame to define a pivot axis in front of the or each blade, and a first magnetic element positioned on the frame beneath the cap for cooperation with a second magnetic element for generating the magnetic return force.

In a preferred embodiment an attachment member is provided for connecting the frame to a handle and includes pivot journals engaged with the pivot structure of the frame, the attachment member having the second magnetic element positioned on the frame.

In a preferred embodiment the pivot axis is located in front of the blade or blades and below a plane tangential to the guard and cap. Also, the rest position is defined by a stop and the blade unit is pivotable in one direction only from the rest position.

Advantageously the magnetic elements which produce the magnetic return force are so arranged that as the angle of pivoting from the rest position increases, the spring rate characteristic of the return force increases. A further advantage of the invention is that the strength of the return force can easily be modified by using magnetic elements of different magnetic strength.

Although the magnetic elements can conveniently be permanent magnets, at least one of the magnetic elements can comprise an electromagnetic element, in which case a control device can be provided for adjusting the electric magnetising current delivered to the electromagnetic element. A sensor may, for example, be provided to sense the pivotal displacement of the blade unit from the rest position and the control device can be responsive to an output from the sensor.

The details of one or more embodiments of the invention are set forth in the accompanying drawings and the description below. Other features, objects, and advantages of the invention will be apparent from the description and drawings, and from the claims.

DESCRIPTION OF DRAWINGS

To assist a clear understanding of the invention some exemplary embodiments are described in detail below with reference to the accompanying drawings in which:—

Like reference symbols in the various drawings indicate like elements.

DETAILED DESCRIPTION

Figure 1:
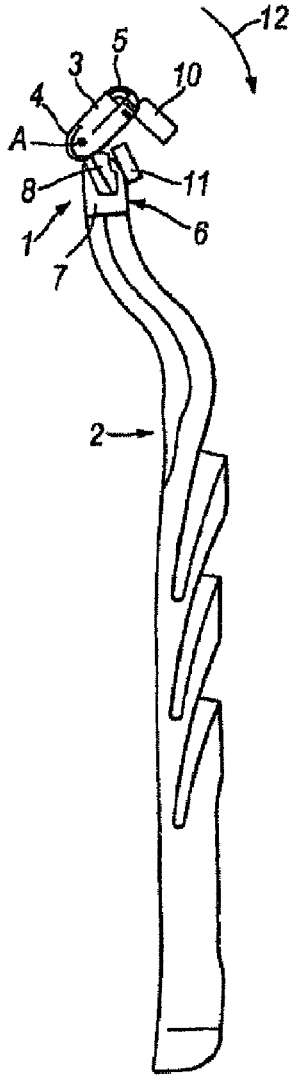
FIG. 1 shows in side elevation a first embodiment of a safety razor in accordance with the invention.
Figure 2:
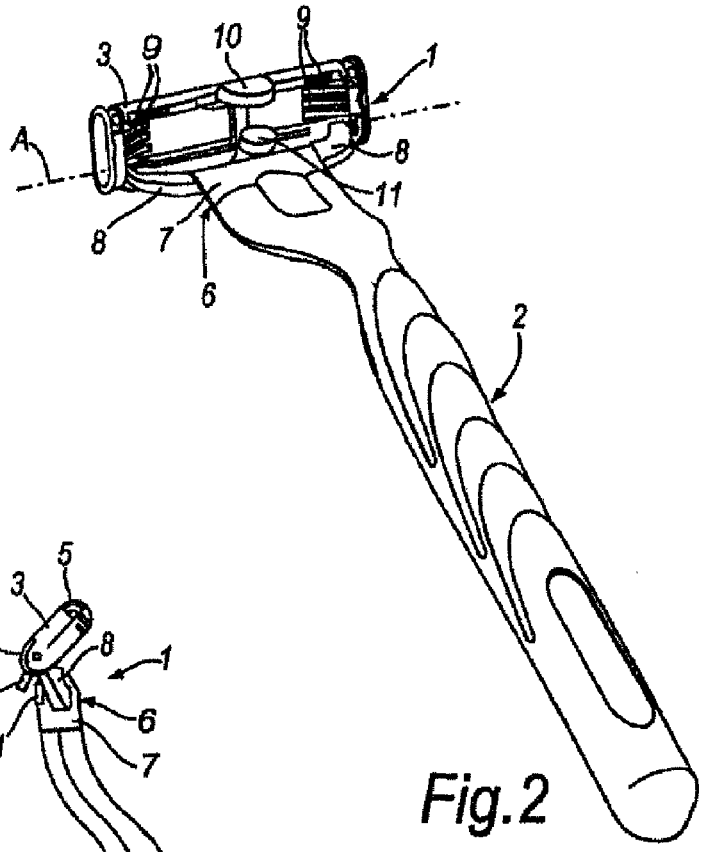
FIG. 2 is a rear perspective view of the safety razor shown in FIG. 1.

The safety razor illustrated in FIGS. 1 and 2 has a blade unit 1 mounted on a handle 2. The blade unit includes a frame 3 with a guard 4 and a cap 5 and a plurality of blades (not shown) positioned between the guard and cap with their cutting edges parallel to each other, as well known in the art. The blades are movable independently of each other and are urged upwardly with respect to a plane tangential to the guard and cap surfaces by springs 9 which determine the force of the blades against the skin during shaving. The guard preferably includes a strip of elastomeric material with projections such as fins, and the cap may comprise a strip for applying a shaving enhancement product for the skin as previously known.

The blade unit is provided with an attachment member 6 including a hub 7 which is clipped detachably onto the upper end of the handle 2, and a pair of opposed yoke arms 8 extending from the hub 7 and having at their ends pivot journals which are inserted into sockets provided at the ends of the frame 3, the journals being retained in the sockets by metal clips applied around the ends of the frame. The journals and sockets define a pivot axis A about which the blade unit 1 is able to pivot relative to the handle 2. The pivot axis A is preferably in front of the blades and below a plane tangential to the guard and cap surfaces, although other pivot positions are possible. The sockets include stop faces against which the arms 8 abut when the frame 3 is in an end pivotal position, as depicted in the drawings, corresponding to a normal rest position of the blade unit. Pivotal movement of the blade unit away from this rest position is opposed by a return force which is produced by a pair of opposed magnetic elements in the form of small permanent magnets 10,11. The first magnet 10 is fixed to the underside of the frame 3 adjacent the cap 5 and the second magnet 11 is fixed to the hub 7 and hence held stationary with respect to the handle 2. The magnets 10,11 are positioned with like poles facing each other so that when they are moved towards each other as a result of the blade unit pivoting away from the rest position as indicated by the arrow 12, a repelling force of increasing strength acting to return the blade unit to the rest position is produced between the magnets.

Figure 3:
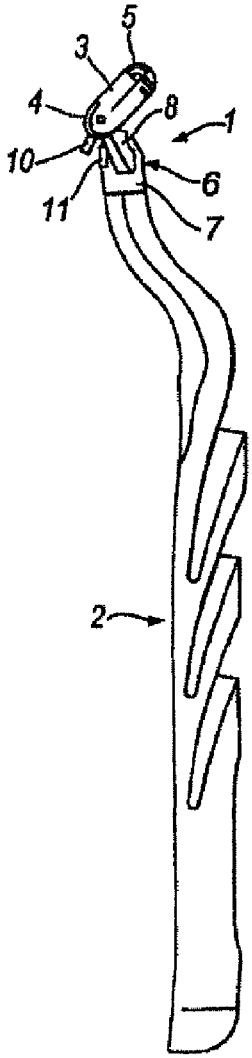
FIG. 3 is a side elevation showing a second embodiment.

The safety razor shown in FIG. 3 differs from that of FIGS. 1 and 2 only in the disposition of the magnets. In this case the first magnet 10 is fixed to the frame 3 adjacent the guard 4 and the second magnet 11 is fixed to the hub 7 at the front thereof to face the first magnet 10. Furthermore, the magnets 10,11 have opposite poles directed towards each other to produce an attractive magnetic force for returning the blade unit to the rest position when it is pivoted away from that position.

Figure 4:
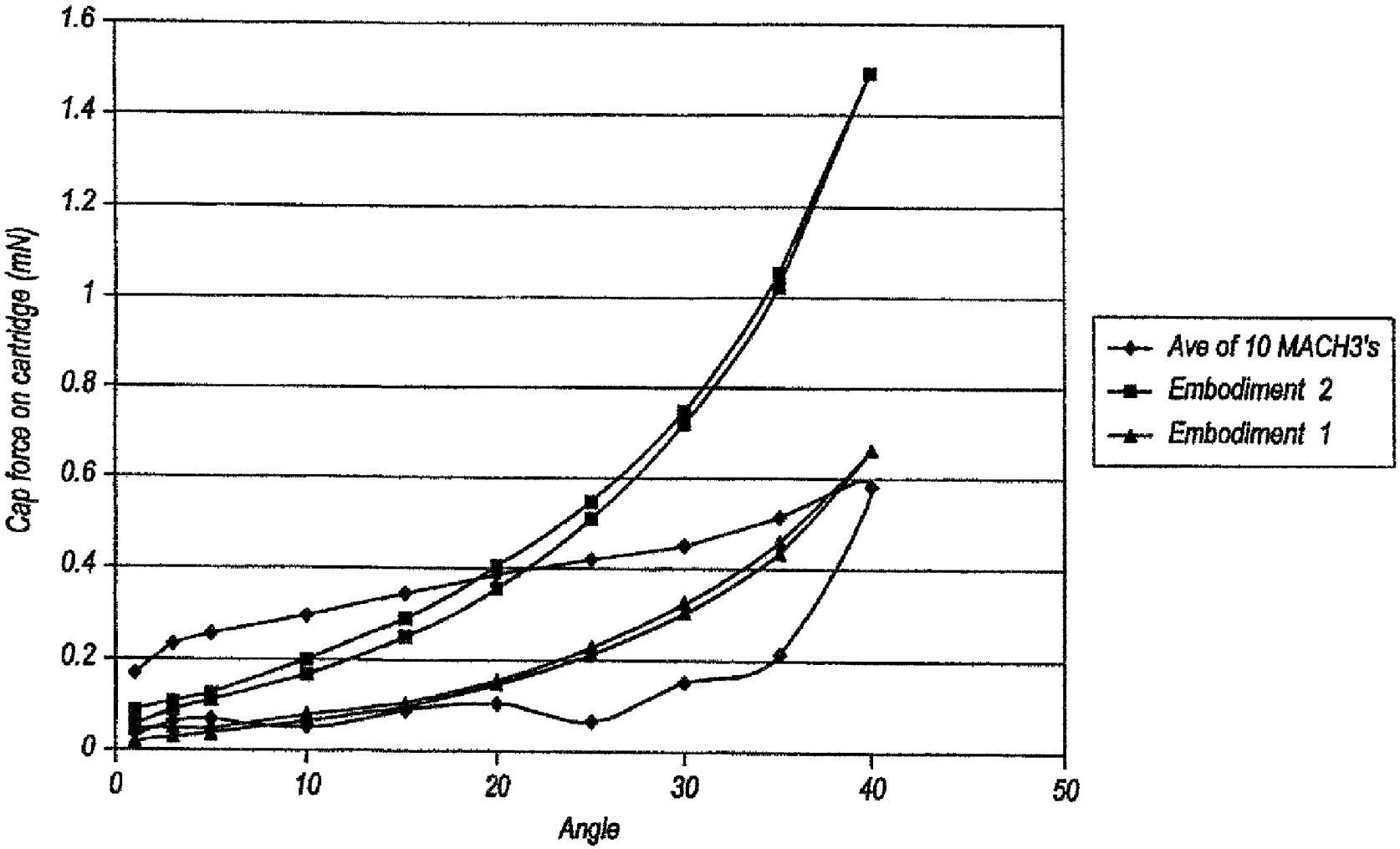
FIG. 4 is a graph showing the return force, measured at the cap, plotted against pivot angle, for two safety razors in accordance with the invention and a prior art razor.

Shown in FIG. 4 is a graph showing return force, measured at the cap of a blade unit, plotted again pivot angle, for two razors embodying the invention and constructed as described above with reference to FIGS. 1 and 2, the two embodiments having magnets of different strength, and a prior art safety razor, namely a Gillette Mach 3 razor which has a construction essentially the same as in the embodiment of FIGS. 1 and 2 but instead of the magnets has a plunger loaded by a mechanical coil spring arranged to bear on the frame of the blade unit to provide the return force. For each of the two razors embodying the present invention the return force characteristic increases smoothly to a maximum, with the effective spring rate of the return force characteristic gradually increasing as the pivot angle increases. Furthermore, during the return pivotal movement towards the rest position the characteristic curve closely follows that relating to the pivotal movement in the opposite direction so that the return force is always consistent for a given pivotal displacement and smooth pivotal motion is achieved, such as if the blade unit undergoes reversals of pivoting direction in the execution of a shaving stroke.

In contrast the characteristic return force curve for the prior art Mach 3 razor has a relatively flat and inconsistent shape and the return forces are differ substantially according to the direction in which the blade unit is pivoting. It may be noted that curve shown for the prior art razor is based on measurements made on a sample of ten razors. The embodiment of the invention employing the weaker magnets, designated Embodiment 1, produces a return force of around the same magnitude as the prior art Mach 3 razor throughout the range of pivotal movement, but with a much smoother and consistent operation as already explained. With the embodiment equipped with the stronger magnets, designated Embodiment 2, however, the return force is of the same order as that produced by the prior art construction over an initial part of the pivotal range, but then the return force rises rapidly over the subsequent part of the pivotal range, in particular with a displacement of 20 to 40 from the rest position, to give a much stronger maximum return force. This effect may be desirable to razor users who refer to press a razor against the skin with relatively large forces.

Modifications to the described embodiments are of course possible without departing from the principles of the invention. It is to be understood, therefore, that the specifically described embodiments are given by way of nonlimiting example only and it is intended that the invention should be limited only by the claims which follow. Whereas permanent magnets are utilised in the embodiments described above, an electromagnetic element can also be used to generate the magnetic return force and this alternative may be convenient if the razor includes a power source, such as a battery, for supplying electric current to an electrical device, such as a motor for driving a vibration generating mechanism. In addition a control device can adjust the electric current delivered to the electromagnetic element, for example in response to an output signal from a sensor for sensing pivotal movement of the blade unit from the rest position, to obtain a desired increase in magnetic return force as the pivotal displacement of the blade unit increases.

A number of embodiments of the invention have been described. Nevertheless, it will be understood that various modifications may be made without departing from the spirit and scope of the invention.

What is claimed is:

1. A safety razor comprising a handle and a blade unit, said blade unit comprising a guard, a cap and at least one blade, the blade unit being mounted to the handle for movement relative thereto about a pivot axis for following skin contours during shaving, the blade unit having a normal rest position towards which the blade unit is biased by a return force when pivoted away from the rest position, wherein the return force comprises a magnetic force generated by magnetic elements that are moved relative to each other in response to pivotal movement of the blade unit relative to the handle, and the return force increases in magnitude as the blade unit pivots away from the rest position.

2. A safety razor according to claim 1, wherein the magnetic elements are arranged to generate a repulsive magnetic return force for urging the blade unit to the rest position.

3. The safety razor according to claim 2, wherein said magnet elements comprise a first magnet and a second magnet, positioned with like poles facing each other.

4. The safety razor of claim 3, wherein when said first magnet and said second magnet are moved towards each other as a result of the blade unit pivoting away from the rest position, a repelling force of increasing strength biases the blade unit to return to the rest position.

5. A safety razor according to claim 1, wherein the blade unit has a frame with the guard and the cap thereon, and a first one of the magnetic elements is mounted to the underside of the frame adjacent the cap.

6. A safety razor according to claim 5, wherein the first magnetic element cooperates with a second magnetic element for generating the magnetic return force.

7. A safety razor according to claim 6, wherein an attachment member is provided for connecting the frame to the handle, the attachment member having the second magnetic element positioned thereon for cooperation with the first magnetic element positioned on the frame.

8. A safety razor blade unit according to claim 1, wherein the pivot axis is positioned in front of the at least one blade.

9. A safety razor according to claim 1, wherein the blade unit is pivotally carried by a pair of opposed arms extending from a hub, and a second one of the magnetic elements is positioned at the hub.

10. A safety razor according to claim 1, wherein the pivot axis is located below a plane tangential to the guard and cap.

11. A safety razor according to claim 1, wherein the rest position is defined by a stop face on the blade unit, the blade unit being pivotable in one direction only from the rest position.

12. A safety razor according to claim 1, wherein as the angle of pivoting from the rest position increases, the spring rate characteristic of the magnetic return force increases smoothly.

13. A safety razor according to claim 1, wherein at least one of the magnetic elements comprises an electromagnetic element.

14. A safety razor according to claim 13, wherein a control device is provided for adjusting the magnetizing current delivered to the electromagnetic element.

* * * * *